United States Patent [19]

Tadenuma et al.

[11] 3,933,660

[45] Jan. 20, 1976

[54] ROLLING OILS

[75] Inventors: Hachiro Tadenuma, Tokyo; Takashi Kato, Yokosuka; Ryoji Kaneda, Zushi; Fumio Ando, Yokosuka; Makoto Yoshino, Yokohama, all of Japan

[73] Assignee: Toho Chemical Industry Co., Ltd., Tokyo, Japan

[22] Filed: Aug. 13, 1974

[21] Appl. No.: 497,042

[52] U.S. Cl. ..... 252/32.5; 72/42; 252/33.4; 252/34.7; 252/41; 252/49.5

[51] Int. Cl.². C10M 1/44; C10M 3/38; C10M 5/24; C10M 7/24

[58] Field of Search ..... 72/42; 252/32.5, 33.4, 252/34.7, 49.5

[56] References Cited

UNITED STATES PATENTS 3,496,104 2/1970 Shimada et al. ..... 252/32.5

3,775,323 11/1973 Dubourg ..... 252/32.5

*Primary Examiner*—Delbert E. Gantz
*Assistant Examiner*—I. Vaughn
*Attorney, Agent, or Firm*—Karl W. Flocks

[57] ABSTRACT

A reducing hot rolling oil for copper and copper alloys comprising 1000 parts by weight of water, 6 – 200 parts by weight of at least one member selected from the group consisting of carboxylic acid type, sulfate type and phosphate type anionic surface active agents, and 0.8 – 200 parts by weight of at least one hydroxyl group-containing compound selected from the group consisting of alcohols, alkylene glycols and glycol ethers. The rolling oil can provide copper and copper alloys with lubricity, oxide film removing ability and oxide film formation preventing ability by spraying between a rolling mill and the metal to be rolled on the hot rolling of copper and copper alloys.

7 Claims, No Drawings

ROLLING OILS

The present invention relates to a rolling oil. More particularly, the invention pertains to a rolling oil which can provide copper and copper alloys with lubricity, oxide film removing ability and oxide film formation preventing ability by spraying between a rolling mill and the metal to be rolled on the hot rolling of copper and copper alloys.

Hot rolling oils for copper and copper alloys which have heretofore been used consist mainly of a mineral oil emulsified with an anionic or nonionic surface active agent. In the case of these rolling oils, as the metal to be rolled is heated to 400– – 900°C on hot rolling, the emulsion particles of the rolling oils become coarse and the emulsion becomes ill-balanced until the oil component of the rolling oils is often separated. Therefore, the rolling oils have defects that they deteriorate rapidly, their lubricating property is reduced, the abrasion of a rolling mill is accelerated, and excess copper soap is formed. Also, when copper and copper alloys are hot rolled, the rolling oils have defect that copper oxide (CuO and $Cu_2O$) film is formed on the surface of the metal, and the oxide film not only causes the abrasion of a die or rolls on cold processing in the subsequent step but also leaves the oxide film even on the surface of the cold processed final product, the surface of the product being blackened. In order to obviate these defects, pickling treatment with, for example, sulfuric acid is carried out after hot rolling to dissolve and remove the oxide film on the surface of copper and copper alloys.

As a result of various studies on the removal of the above-mentioned defects in the hot rolling of copper and copper alloys, the present inventors have completed the present invention.

The rolling oils of the present invention are of solution-type and are excellent in stability. Thus, they are always in the form of a clean liquid.

If copper and copper alloys are rolled with the rolling oils of the present invention, a rolled copper material free from an oxide film and having a smooth surface can be obtained. Therefore, the rolling oils of the present invention have advantages in that the pickling step can be omitted, thereby cost being remarkably reduced owing to curtailment of steps and waste liquid treatment, working environment such as operational safety is improved, and the loss of copper and copper alloy materials on rolling is reduced by the prevention of copper oxide formation on hot rolling.

According to the present invention, a reducing hot rolling oil for copper and copper alloys comprising 1000 parts by weight of water, 6 – 200 parts by weight of at least one member selected from the group consisting of carboxylic acid type, sulfate type and phosphate type anionic surface active agents, and 0.8 – 200 parts by weight of at least one hydroxyl group-containing compound selected from the group consisting of alcohols, alkylene glycols and glycol ethers is provided.

The carboxylic acid type, sulfate type and phosphate type anionic surface active agents used in the present invention are effective for preventing the abrasion of a rolling mill, providing lubricity, removing an oxide film and preventing the formation of copper oxide on the hot rolling of copper and copper alloys at a temperature of about 400°C or more.

The carboxylic acid type anionic surface active agents are carboxylic acid salts represented by the general formula $$RCOOM$$

wherein R is an alkyl group having 12 22 carbon atoms and M is Na, K, $NH_4$, $NH_2C_2H_4OH$, $NH(C_2H_4OH)_2$ or $N(C_2H_4OH)_3$. The fatty acid RCOOH is exemplified by lauric acid, palmitic acid, stearic acid, linolic acid, ricinolic acid, linolenic acid, oleic acid and erucic acid. Natural fatty acids such as rapeseed oil fatty acid, soybean oil fatty acid, rice bran oil fatty acid, coconut oil fatty acid, castor oil fatty acid and palm oil fatty acid are excellent in lubricating property. Rapeseed oil fatty acid, rice bran fatty acid, caster oil fatty acid and palm oil fatty acid are comparatively easy to use in commercial practice of the present invention owing to their cheapness.

The sulfate type anionic surface active agents are salts of higher alcohol sulfuric acid esters represented by the general formula $$ROSO_3M,$$

petroleum sulfonates represented by the general formula $$RSO_3M,$$

salts of sulfuric acid esters of fatty acids or esters thereof represented by the general formula $$R(OSO_3M)COOR',$$

and sulfates of aliphatic amines and aliphatic amides represented by the general formula $$RCONHR'CH_2CH_2OSO_3M.$$

In these formulas, R and R′ represent an alkyl group having 11 – 21 carbon atoms and fatty acids are the same as in the above-mentioned carboxylic acid type anionic surface active agents when R and R′ are a fatty acid residue, and represent an alkyl group having 12 – 18 carbon atoms when R and R′ are a higher alcohol residue. The higher alcohol is exemplified by lauryl alcohol, palmityl alcohol, stearyl alcohol and oleyl alcohol, but synthetic alcohols as a mixture of saturated alcohols having 12, 14 and 16 carbon atoms, respectively, are commercially easy to use owing to their cheapness and thermal stability.

Further, the phosphate type anionic surface active agents are ethylene oxide-added phosphoric acid ester salts represented by the general formulas

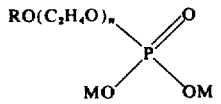

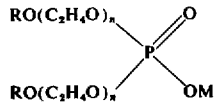

and alkylphosphoric acid ester salts represented by the general formulas $$(RO)_2PO(OM)$$

or $$(RO)PO(OM)_2.$$

In these formulas, R is the same as exemplified in the sulfate type anionic surface active agents when R is a higher alcohol residue and is preferably nonylphenol or octylphenol residue when R is an alkylphenol residue, *n* is an average addition mole number as a mixture of mono- and di-esters and preferably 2 – 15, and M has the same meaning as that defined in the carboxylic acid type anionic surface active agents.

The hydroxyl-group containing compounds such as alcohols, alkylene glycols and glycol ethers used in the present invention are effective for removing an oxide film, preventing the formation of copper oxide and providing lubricity on the hot rolling of copper or copper alloys.

Therefore, the use of the hydroxyl group-containing compounds together with the above-mentioned anionic surface active agents produces a synergistic effect of lubrication and reduction.

The alcohols include methyl alcohol, ethyl alcohol, n-propyl alcohol, n-butyl alcohol, isopropyl alcohol and isobutyl alcohol.

The alkylene glycols include ethylene glycol, propylene glycol, butylene glycol and hexylene glycol.

The glycol ethers include ethylene glycol monomethyl ether, ethylene glycol monoethyl ether, ethylene glycol monopropyl ether, ethylene glycol monobutyl ether, diethylene glycol monomethyl ether, diethylene glycol monoethyl ether, diethylene glycol monopropyl ether and diethylene glycol monobutyl ether.

If an amount of the anionic surface active agent added is 4 parts by weight per 1000 parts by weight of water or less in the present invention, wear track area and film strength are reduced and lubricity becomes poor. If the amount is 6 parts by weight per 1000 parts by weight of water or more, wear track area and film strength are improved and lubricity becomes better. Also, if the amount exceeds 200 parts by weight per 1000 parts by weight of water, reducing property does not change but cooling property is reduced. Therefore, the amount of the anionic surface active agent is suitably 6 to 200 parts by weight per 1000 parts by weight of water.

If an amount of the hydroxyl group-containing compound added is 0.5 part by weight per 1000 parts by weight of water or less, the surface of copper or copper alloys after rolling turns red, the thickness of the oxide film increases, and reduction time becomes longer. If the amount is 0.8 part by weight per 1000 parts by weight of water or more, copper or copper alloys after rolling is clean and bright and is essentially free of surface oxidation, almost no oxide film is formed, and reduction time becomes very short. Also, if the amount exceeds 200 parts by weight per 1000 parts by weight of water, the lubricating property of the rolling oil does not change but its flash point is reduced. Therefore, the amount of the hydroxyl group-containing compound added is suitably 0.8 to 200 parts by weight per 1000 parts by weight of water.

A total amount of the anionic surface active agent and the hydroxyl group-containing compound is preferably 10 to 100 parts by weight per 1000 parts by weight of water, among which the hydroxyl group-containing compound amounts 5 to 30 parts by weight.

The rolling oils for the rolling of copper or copper alloys according to the present invention are preferably kept alkaline, that is, the pH of the rolling oils is preferably maintained at 8.0 or more in order to prevent the formation of copper oxide and copper soap.

As for the reducing property of the rolling oils according to the present invention, alcohols produce a very rapid effect while alkylene glycols and glycol ethers produce a slower effect. However, the use of alcohols together with alkylene glycols and/or glycol ethers is effective, since alcohols are rapidly consumed.

Also, as for the lubricating property of the rolling oils according to the present invention, it is preferable to use 10 to 100% by weight of a fatty acid ester nonionic surface active agent together with an anionic surface active agent based on the weight of the anionic surface active agent since the life of the rolling oils can be thereby prolonged (although the life of a rolling mill is not substantially affected.).

The following examples, in which all parts are expressed by weight, unless otherwise indicated, will serve to illustrate the practice of the invention in more detail. The performance of the rolling oils obtained was tested by the following testing methods:

1. Lubricity test

Wear track area and film strength were measured by the use of a Soda four-ball tester according to JIS K 2519 "Testing Method for Load Carrying Capacity of Petroleum Products."

Wear track area was measured by using three brass balls as fixed balls and one steel ball as a rotating ball and rotating the steel ball at 200 r.p.m. under a load of 2 kg/cm$^2$ for 20 minutes.

Also, film strength was measured by using three steel balls as fixed balls and one steel ball as a rotating ball and rotating the steel ball at 200 r.p.m. while a load was increased from a no-load state at a rate of 0.5 kg/cm$^2$ per minute.

2. Reducing property test

A copper material of 8 mm in diameter was heated to 700°C by a gas burner, and the heated copper material was immediately immersed in a sample liquid. The time elapsed until the surface of the copper material turned clean and bright was measured as a criterion for evaluating the reducing property of the sample liquid.

When the surface of the copper material turned clean and bright, the thickness of the remaining oxide film was found to be about 0.1 – 0.2 $\mu$ (as CuO) and substantially no oxide film was formed.

EXAMPLE 1

1000 Parts of water, 20 parts of rapeseed oil fatty acid potassium salt (a 1% aqueous solution of which showed a pH of 11.0) and 10 parts of methyl alcohol were mixed to obtain a rolling oil.

The lubricating and reducing properties of the resulting rolling oil were found to be satisfactory as a hot rolling oil for copper and copper alloys as follows:

| | |
|---|---|
| Lubricating property: | |
| Wear track area | 0.325 mm$^2$ |
| Film strength | 10.0 kg/cm$^2$ |
| Reducing property: | |
| Appearance of copper surface | Clean and bright and essentially free of surface oxidation |
| Thickness of copper oxide (as CuO) | 0.03 $\mu$ |
| Reduction time | <0.5 sec. |

EXAMPLES 2 – 5

In the same manner as in Example 1, rolling oils were produced according to the recipes as mentioned in Table 1. The lubricating and reducing properties of the resulting rolling oils are also shown in Table 1.

Table 1

| Example | 2 | 3 | 4 | 5 |
|---|---|---|---|---|
| Water (parts) | 1000 | 1000 | 1000 | 1000 |
| Rapeseed oil fatty acid potassium salt*(parts) | 20 | 200 | 6 | 6 |
| Propyl alcohol (parts) | 10 | 0.8 | 200 | 0.8 |
| Lubricating property: | | | | |
| Wear track area ($mm^2$) | 0.324 | 0.303 | 0.605 | 0.602 |
| Film strength ($kg/cm^2$) | 10.0 | 11.0 | 6.0 | 6.5 |
| Reducing property: | | | | |
| Appearance of copper surface | Clean and bright and essentially free of surface oxidation | | | |
| Thickness of copper oxide (as CuO) ($\mu$) | 0.03 | 0.12 | 0.01 | 0.12 |
| Reduction time (sec.) | <0.5 | 1.0 | <0.5 | 1.0 |

*A 1% aqueous solution of the rapeseed fatty acid potassium salt showed a pH of 11.0.

As is clear from the above table, all of the resulting rolling oils showed satisfactory performance as a hot rolling oil for copper and copper alloys. (The recipes in Examples 3 and 5 are the lower and upper limits in the process of the present invention.)

EXAMPLES 6 – 12

In the same manner as in Example 1, rolling oils were produced by mixing 1000 parts of water, 20 parts of the same rapeseed oil fatty acid potassium salt as used in Examples 1 – 5 and 10 parts of different hydroxy group-containing compounds. The hydroxy group-containing compounds used and the lubricating and reducing properties of the resulting rolling oils are shown in Table 2.

Table 2

| Example | 6 | 7 | 8 | 9 | 10 | 11 | 12 |
|---|---|---|---|---|---|---|---|
| Hydroxyl group-containing compound | Butyl alcohol | Ethylene glycol | Hexylene glycol | Ethylene glycol monomethyl ether | Diethylene glycol monomethyl ether | Ethylene glycol monobutyl ether | Diethylene glycol monobutyl ether |
| Lubricating property: | | | | | | | |
| Wear track area ($mm^2$) | 0.323 | 0.325 | 0.325 | 0.323 | 0.325 | 0.323 | 0.323 |
| Film strength ($kg/cm^2$) | 10.0 | 10.0 | 10.0 | 10.0 | 10.0 | 10.0 | 10.0 |
| Reducing property: | | | | | | | |
| Appearance of copper surface | Clean and bright and essentially free of surface oxidation | | | Clean and bright and essentially free of surface oxidation | | | |
| Thickness of copper oxide (as CuO) ($\mu$) | 0.03 | 0.13 | 0.04 | 0.07 | 0.08 | 0.05 | 0.05 |
| Reduction time (sec.) | <0.5 | 1.5 | <0.5 | 1.0 | 1.0 | <0.5 | <0.5 |

EXAMPLES 13 – 31

In the same manner as in Example 1, rolling oils were produced by mixing 1000 parts of water, 10 parts of propyl alcohol and 20 parts of different anionic surface active agents. The anionic surface active agents used and the lubricating and reducing properties of the resulting rolling oils are shown in Table 3.

Table 3

| Example | 13 | 14 | 15 | 16 | 17 | 18 |
|---|---|---|---|---|---|---|
| Anionic surface active agent | Lauric acid triethanol-amine salt | Oleic acid potassium salt | Erucic acid sodium salt | Coconut oil fatty acid diethanol-amine salt | Lauryl alcohol sulfuric acid ester triethanol-amine salt | Oleyl alcohol sulfuric acid ester potassium salt |
| Lubricating property: | | | | | | |
| Wear track area ($mm^2$) | 0.327 | 0.324 | 0.320 | 0.325 | 0.331 | 0.335 |
| Film strength ($kg/cm^2$) | 9.5 | 9.5 | 10.0 | 9.5 | 10.0 | 10.0 |
| Reducing property: | | | | | | |
| Appearance of copper surface | Clean and bright and essentially free of surface oxidation | | Clean and bright and essentially free of surface oxidation. | | | |
| Thickness of copper oxide (as CuO) ($\mu$) | 0.03 | 0.03 | 0.03 | 0.03 | 0.03 | 0.03 |
| Reduction time (sec.) | <0.5 | <0.5 | <0.5 | <0.5 | <0.5 | <0.5 |

| Example | 19 | 20 | 21 | 22 | 23 | 24 | 25 | 26 |
|---|---|---|---|---|---|---|---|---|
| Anionic surface active agent | Synthetic alcohol ($C_{12}$ 60% $C_{14}$ 40%) sulfuric acid ester monoethanol-amine salt | Petroleum sulfonic acid sodium salt (molecular weight about 500) | Ricinolic acid lauryl alcohol ester sulfuric acid ester potassium salt | Erucic acid oleyl alcohol ester sulfuric acid ester triethanol-amine salt | Castor oil sulfuric acid ester potassium salt | Laurylamine sulfuric acid ester potassium salt | Oleic acid diethanol-amide sulfuric acid ester potassium salt | Poly(oxyethylene) lauryl ether phosphoric acid mono- and diester triethanol-amine salt (monoester ca. 60% diester ca. 40%, ethylene oxide addition mole number 2) |
| Lubricating property: | | | | | | | | |
| Wear track area ($mm^2$) | 0.338 | 0.330 | 0.321 | 0.320 | | | | |
| Film strength ($kg/cm^2$) | 10.0 | 11.5 | 16.5 | 17.0 | | | | |
| Reducing property: | | | | | | | | |
| Appearance of copper surface | Clean and bright and essentially free of surface oxidation | | | | | | | |
| Thickness of copper oxide (as CuO) ($\mu$) | 0.03 | 0.03 | 0.03 | 0.03 | | | | |
| Reduction time (sec.) | <0.5 | <0.5 | <0.5 | <0.5 | | | | |

Table 3-continued

| Example | 23 | 24 | 25 | 26 |
|---|---|---|---|---|
| | 0.320 | 0.338 | 0.341 | 0.330 |
| | 17.0 | 10.0 | 10.5 | 17.5 |
| | Clean and bright and essentially free of surface oxidation | | | |
| | 0.03 | 0.03 | 0.03 | 0.03 |
| | <0.5 | <0.5 | <0.5 | <0.5 |

| | 27 | 28 | 29 |
|---|---|---|---|
| | Poly(oxyethylene) oleyl ether phosphoric acid mono- and diester potassium salt (monoester ca. 60% diester ca. 40%, ethylene oxide addition mole number 2) | Poly(oxyethylene) nonylphenol ether phosphoric acid mono- and diester monoethanolamine salt (monoester ca. 60% diester ca. 40%, ethylene oxide addition mole number 4) | Poly(oxyethylene) octylphenol ether phosphoric acid mono- and diester sodium salt (monoester ca. 60% diester ca. 40%, ethylene oxide addition mole number 15) |
| | 0.332 | 0.338 | 0.337 |
| | 17.5 | 17.0 | 16.5 |
| | Clean and bright and essentially free of surface oxidation | | |
| | 0.03 | 0.03 | 0.03 |
| | <0.5 | <0.5 | <0.5 |

| | 30 | 31 |
|---|---|---|
| | Lauryl phosphate triethanolamine salt | Oleyl phosphate potassium salt |
| | 0.335 | 0.335 |
| | 16.0 | 16.0 |
| | Clean and bright and essentially free of surface oxidation | |
| | 0.03 | 0.03 |
| | <0.5 | <0.5 |

EXAMPLES 32 – 34

Rolling oils were produced according to the recipes as mentioned in Table 4.

Table 4

| Example | 32 | 33 | 34 |
|---|---|---|---|
| Water (parts) | 1000 | 1000 | 1000 |
| Lauryl alcohol sulfuric acid ester triethanolamine salt* (parts) | 20 | 20 | 100 |
| Isopropyl alcohol (parts) | 4 | 7 | 20 |
| Hexylene glycol (parts) | 1 | 3 | 10 |

*A 1% aqueous solution of the salt showed a pH of 10.0.

EXAMPLE 35

A rolling oil was produced according to the following recipe:

| | Parts |
|---|---|
| Water | 1000 |
| Rapeseed oil fatty acid potassium salt* | 20 |
| Poly(oxyethylene) lauryl ether phosphoric acid mono- and diester triethanolamine salt (monoester ca. 60% diester ca. 40%, ethylene oxide addition mole number 2) | 5 |
| Isopropyl alcohol | 7 |
| Ethylene glycol monobutyl ether | 3 |

*A 1% aqueous solution of the salt showed a pH of 11.0.

EXAMPLE 36

A rolling oil was produced according to the 10 following recipe:

| | Parts |
|---|---|
| Water | 1000 |
| Rapeseed oil fatty acid potassium salt* | 30 |
| Petroleum sulfonic acid sodium salt** | 5 |
| Poly(oxyethylene) dilaurate (ethylene oxide addition mole number 10) | 5 |
| Ethyl alcohol | 10 |
| Hexylene glycol | 4 |

*A 1% aqueous solution of the salt showed a pH of 11.0.
**A 1% aqueous solution of the salt showed a pH of 10.5.

EXAMPLE 37

A rolling oil was produced according to the following recipe:

| | Parts |
|---|---|
| Water | 1000 |
| Oleic acid potassium salt* | 25 |
| Caster oil sulfuric acid ester potassium salt** | 10 |
| Methyl alcohol | 10 |
| Hexylene glycol | 3 |
| Ethylene glycol monobutyl ether | 3 |

*A 1% aqueous solution of the salt showed a pH of 11.0.
**A 1% aqueous solution of the salt showed a pH of 11.0.

EXAMPLE 38

A rolling oil was produced according to the following recipe:

| | Parts |
|---|---|
| Water | 1000 |
| Rapeseed oil fatty acid potassium salt* | 25 |
| Petroleum sulfonic acid sodium salt** | 5 |
| Poly(oxyethylene) nonylphenol ether phosphoric acid mono- and diester monoethanolamine salt (monoester ca. 60% diester ca. 40%, ethylene oxide addition mole number 4) | 5 |
| Isopropyl alcohol | 9 |
| Hexylene glycol | 3 |
| Ethylene glycol monobutyl ether | 3 |

*A 1% aqueous solution of the salt showed a pH of 11.0.
**A 1% aqueous solution of the salt showed a pH of 10.5.

EXAMPLE 39

A rolling oil was produced according to the following recipe:

| | Parts |
|---|---|
| Water | 1000 |
| Rapeseed oil fatty acid potassium salt* | 8 |

-continued

| | Parts |
|---|---|
| Petroleum sulfonic acid potassium salt** | 3 |
| Poly(oxyethylene) nonylphenol ether phosphoric acid mono- and diester triethanolamine salt (monoester ca. 60% diester ca. 40%, ethylene oxide addition mole number 7) | 3 |
| Poly(oxyethylene) dioleate (ethylene oxide addition mole number ca. 14) | 4 |
| Isopropyl alcohol | 11 |
| Hexylene glycol | 4 |

*A 1% aqueous solution of the salt showed a pH of 11.0.
**A 1% aqueous solution of the salt showed a pH of 10.5.

The lubricating and reducing properties of the rolling oils obtained in Examples 32 – 38 are shown in Table 5 in comparison with those of a prior art rolling oil.

Table 5

| Example | Lubricating property: Wear track area (mm²) | Lubricating property: Film strength (kg/cm²) | Reducing property: Appearance of copper surface | Reducing property: Thickness of copper oxide (as CuO) (μ) | Reducing property: Reduction time (sec.) |
|---|---|---|---|---|---|
| 32 | 0.327 | 9.5 | Clean and bright and essentially free of surface oxidation | 0.05 | 0.5 |
| 33 | 0.327 | 9.5 | | 0.03 | < 0.5 |
| 34 | 0.301 | 14.5 | | 0.02 | < 0.5 |
| 35 | 0.320 | 16.5 | | 0.03 | < 0.5 |
| 36 | 0.319 | 16.0 | | 0.03 | < 0.5 |
| 37 | 0.312 | 17.0 | | 0.03 | < 0.5 |
| 38 | 0.313 | 17.5 | | 0.03 | < 0.5 |
| Prior art rolling oil | 0.480 | 6.0 | Black red | 6.0 | Not reducing |
| Blank test | — | — | Black | 10.0 | Not reducing |

Notes:
(1) The prior art rolling oil is a 3% aqueous solution obtained by mixing 80 parts of a mineral oil, 5 parts of an oil or fat, 5 parts of a soap, 10 parts of a nonionic surface active agent and water.
(2) The blank test was carried out by heating a copper material to 700°C, allowing the material to cool in air and measuring.

The use of the rolling oils according to the present invention in the hot rolling of a copper wire material is explained below.

A roll stand is tightly sealed in order to prevent the invasion of oxygen into a rolling mill, wherein a material to be rolled is completely immersed in a rolling oil. The rolled material leaves the rolling mill and then enters a cooling pipe filled with the rolling oil, where the material is cooled to a temperature at which substantially no oxide film is formed, that is, a temperature of 80°C or less and then wound up by a winder into a bundle. Here, the temperature at the inlet of the rolling mill is 750°C and that at the outlet of the rolling mill is 600°C.

A comparison of the performance of the rolling oils according to the present invention with that of a prior art rolling oil is as shown in Table 6.

Table 6

| Example | Appearance of hot rolled material | Thickness of copper oxide as CuO (μ) |
|---|---|---|
| 2 | Clean and bright and essentially free of surface oxidation | 0.03 |
| 8 | | 0.06 |
| 11 | | 0.07 |
| 14 | | 0.03 |
| 18 | | 0.03 |

Table 6-continued

| Example | Appearance of hot rolled material | Thickness of copper oxide as CuO (μ) |
|---|---|---|
| 27 | Clean and bright and essentially free of surface oxidation | 0.03 |
| 36 | | 0.03 |
| 37 | | 0.03 |
| 38 | | 0.03 |
| Prior art oil* | Black | 9.75 |

*3% aqueous solution

Also, in the case of the prior art oil, the thickness of copper oxide after hot rolling and sulfuric acid treatment is 0.03 – 0.05 μ as CuO. When the sulfuric acid treatment is effected, the surface of the rolled material becomes frosted. On the other hand, in the case of the rolling oils according to the present invention, the surface of the rolled material is always lustrous and smooth.

As for lubricating property, when the rolling oils according to the present invention are used, the abrasion speed of the rolls is reduced to about ½ to ⅓ of that in the use of prior art rolling oils. Further, the inside of the rolling mill, an oil tank and a circulating pipe do not become sticky but remain clean as compared with the case of prior art oils.

As described above, when the rolling oils according to the present invention are used as a hot rolling oil for copper and copper alloys, the life of the rolls are prolonged and the inside of the rolling mill and the other apparatuses remain clean as compared with the use of prior art oils, that is, mineral oil-based emulsion type lubricants. Further, sulfuric acid treatment is not required owing to the formation of no oxide film and the rolled material can be directly used as a starting material in the subsequent cold processing step.

What is claimed is:

1. A reducing hot rolling oil for copper and copper alloys comprising 1000 parts by weight of water, 6 – 200 parts by weight of at least one member selected from the group consisting of carboxylic acid type, sulfate type and phosphate type anionic surface active agents, and 0.8 – 200 parts by weight of at least one hydroxyl group-containing compound selected from the group consisting of alcohols, alkylene glycols and glycol ethers.

2. A reducing rolling oil according to claim 1, which comprises 1000 parts by weight of water, 5 – 95 parts by weight of at least one member selected from the group consisting of carboxylic acid type, sulfate type and phosphate type anionic surface active agents, and 5 – 30 parts by weight of at least one hydroxyl group-containing compound selected from the group consisting of alcohols, alkylene glycols and glycol ethers.

3. A reducing rolling oil according to claim 1 which has a pH of at least 8.0.

4. A reducing rolling oil according to any one of claims 1 – which further contains 10 – 100% by weight of a nonionic surface active agent based on the weight of the anionic surface active agent.

5. A reducing rolling oil according to claim 1, which consists of 1000 parts by weight of water, 10 parts by weight of propyl alcohol and 20 parts by weight of oleic acid potassium salt.

6. A reducing rolling oil according to claim 1, which consists of 1000 parts by weight of water, 20 parts by weight of rapeseed oil fatty acid potassium salt (a 1% aqueous solution of which has a pH of 11.0). 5 parts by weight of poly(oxyethylene) lauryl ether phosphoric acid mono- and diester triethanolamine salt (monoester ca. 60% diester ca. 40%, ethylene oxide addition mole number 2), 7 parts by weight of isopropyl alcohol and 3 parts by weight of ethylene glycol monobutyl ether.

7. A reducing rolling oil according to claim 1, which consists of 1000 parts by weight of water, 8 parts by weight of rapeseed oil fatty acid potassium salt (a 1% aqueous solution of which has a pH of 11.0), 3 parts by weight of petroleum sulfonic acid potassium salt (a 1% aqueous solution of which has a pH of 10.5), 3 parts by weight of poly(oxyethylene) nonylphenol ether phosphoric acid mono- and diester triethanolamine salt (monoester ca. 60% diester ca. 40%, ethylene oxide addition mole number 7), 4 parts by weight of poly(oxyethylene) dioleate (ethylene oxide addition mole number ca. 14), 11 parts by weight of isopropyl alcohol and 4 parts by weight of hexylene glycol.

* * * * *